United States Patent [19]

Bales

[11] 4,396,578

[45] Aug. 2, 1983

[54] WHITE GOLD JEWELRY ALLOY

[76] Inventor: Randy L. Bales, 267 Lookwood Ave., Hamilton, Ohio 45011

[21] Appl. No.: 343,022

[22] Filed: Jan. 27, 1982

[51] Int. Cl.[3] ..... C22C 30/02; C22C 30/06

[52] U.S. Cl. ..... 420/587; 420/580

[58] Field of Search ..... 420/580, 587, 581, 582, 420/589

[56] References Cited

U.S. PATENT DOCUMENTS

| | | | |
|---|---|---|---|
| 2,050,077 | 8/1936 | Wise | 420/587 |
| 2,222,544 | 11/1940 | Spanner et al. | 420/587 X |
| 2,279,284 | 4/1942 | Wassermann | 420/522 |
| 2,460,595 | 2/1949 | Reich | 420/587 |
| 4,012,228 | 3/1977 | Dudek et al. | 420/587 |
| 4,264,359 | 4/1981 | Harris et al. | 420/587 |

*Primary Examiner*—L. Dewayne Rutledge
*Assistant Examiner*—David A. Hey
*Attorney, Agent, or Firm*—Wood, Herron & Evans

[57] ABSTRACT

A jewelry alloy is disclosed containing no gold or preferably less than one-half karat gold having the color, hue and shine characteristics of 10 or higher karat white gold. Although the alloy disclosed is virtually identical in appearance to 10 to 18 karat white gold, it is substantially less expensive and provides a relatively low cost substitute for 10 and higher karat white gold. The alloy has the following composition, by weight:

| | |
|---|---|
| Silver | 21–35% |
| Palladium | 10–23% |
| Nickel | 3–15% |
| Copper | 25–42% |
| Zinc | 3–17% |

In addition to its appearance, the alloy disclosed has good corrosion and high tarnish resistance, good workability and castability and can be plated, if desired, and sized with conventional solders.

7 Claims, No Drawings

WHITE GOLD JEWELRY ALLOY

FIELD OF THE INVENTION

The subject invention is directed to alloys for use in making jewelry and, more particularly, to white gold alloys containing not more than about 2% by weight gold or approximately less than one-half karat.

BACKGROUND OF THE INVENTION

Even before the recent dramatic increases in the price of gold, there had been an effort by workers in the art to develop gold alloys having the appearance of 10, 12, 14, and 18 karat gold but with a much lower gold content. However, many problems have been encountered in achieving the desired durability, workability, corrosion and tarnish resistance and particularly in simulating the appearance of white gold alloys as the percentages of gold have been decreased to provide a lower cost substitute for 10 and higher karat gold. Representative of the efforts of prior art workers are the following patents, U.S. Pat. Nos. 2,460,595; 2,279,284; 4,012,228; and 4,264,359.

The problems of providing a truly low cost substitute for 10 or higher karat white gold having the desired color, hue and luster as well as other desirable properties such as resistance to corrosion and tarnishing as well as a reduction of surface roughness have heretofore not been overcome in the prior art.

For example, the alloy disclosed in the Reich patent, U.S. Pat. No. 2,460,595 is very brittle and thus not useful for jewelry, has a relatively high melting point because of the high palladium content, and cannot be satisfactorily sized with conventional solders. Moreover, white gold as we know it today has a slight but definitely yellow hue. The Reich alloy lacks this hue, i.e., it is too "white."

SUMMARY OF THE INVENTION

The alloys of this invention contain less than about 2% by weight gold, and preferably 0 to 1% by weight gold, but contrasted to prior art alloys nevertheless do have the color, hue and luster of 10 and higher karat white gold and, in addition, exhibit good resistance to corrosion and tarnishing, are easily cast, are sufficiently malleable to be easily worked, can be plated, if desired, can be sized with conventional solders, and can be remelted a number of times. The color, luster, shine and hue of the alloys of the present invention are substantially identical to that of 10 or higher karat white gold. These properties are achieved by a substitute white gold alloy having the following composition, by weight:

| | |
|---|---|
| Silver | 21–35% |
| Palladium | 10–23% |
| Nickel | 3–15% |
| Copper | 25–42% |
| Zinc | 3–17% |

Optional elements which may be present in the alloy by weight include gold up to 2%, platinum up to 5%, tin up to 3%, cadmium up to 10%, gallium up to 5%, aluminum up to 3%, and iron up to 3%.

A presently preferred composition of the alloy is as follows, all percentages by weight:

| | |
|---|---|
| Silver | 25.30% |
| Palladium | 16.80% |
| Nickel | 9.60% |
| Copper | 32.40% |
| Zinc | 13.40% |
| Platinum | 1.55% |
| Gold | 0.86% |
| | 99.91% |

The balance consists of trace amounts of iron, aluminum and tin.

DETAILED DESCRIPTION OF THE INVENTION

This invention provides low cost white gold alloys having highly desirable physical and chemical properties including the color, hue, luster and shine characteristics found in 10 and higher karat white gold. According to the practice of this invention, low cost substitute white gold alloys may be produced with good corrosion and tarnish resistance, good workability and good castability. The alloy can be hammered, cast, rolled and made into wire. Thus, the alloy is capable of being formed into a variety of sizes and shapes by techniques traditionally used in the jewelry industry to form jewelry articles of a desired size and configuration. The alloy may also be cut and sized with solders conventionally used in the jewelry industry and can be plated with precious metals such as rhodium if desired. The alloy is preferably in the less than one-half karat gold range, that is, up to about 2% gold and preferably 0 to 1% gold. Thus, the alloy is relatively low cost but nevertheless has a surface appearance including color, luster, shine and hue which is substantially identical to that of 10 higher karat white gold. The alloy contains the following constituents in weight %:

| | |
|---|---|
| Silver | 21–35% |
| Palladium | 10–23% |
| Nickel | 3–15% |
| Copper | 25–42% |
| Zinc | 3–17% |

Various optional elements may be found in the alloy. Platinum up to 5% may be added to improve tarnish resistance. Tin up to 3% improves the hardness of the alloy and provides a little better color. Gallium up to 5% provides the alloy with a slightly better color. Aluminum may be present up to 3%; however, a high percentage of aluminum decreases the tarnish resistance of the alloy. Iron up to 3% keeps the alloy from turning too white with age. However, higher percentages of iron decrease the tarnish resistance of the alloy.

Cadmium added to the alloy composition in amounts up to 10% provides a solder for soldering the alloys of the present invention.

A presently preferred alloy has the following composition:

| | |
|---|---|
| Silver | 25.30% |
| Palladium | 16.80% |
| Nickel | 9.60% |
| Copper | 32.40% |
| Zinc | 13.40% |
| Platinum | 1.55% |
| Gold | 0.86% |
| | 99.91% |

with the balance consisting of trace amounts of nickel, iron and tin.

The alloy may be melted in the 1000°–1100° C. range and cast and shaped with conventional techniques. One of the additional advantages of the alloy is that it can be remelted six to ten times whereas 10 and higher karat gold can only be remelted about three or four times before it must be reconstituted.

Unlike known white gold alloys, the alloy of the present invention surprisingly exhibits good resistance to corrosion and tarnishing, good workability and surface smoothness as well as a color, luster, shine and hue at least equivalent to that of 10 karat gold. In fact, it has been observed that rings formed of the gold alloy herein may be sized using conventional gold solders without one being able to discern where the alteration was made. As is generally known, most, if not all, of the metal alloys used in jewelry today cannot be sized with conventional solders to provide an acceptable finished appearance. Therefore, in addition to the cost savings realized by the white gold alloy having reduced gold content to less than one-half karat, the fact that rings and other jewelry articles made therefrom can be sized is an important advantage over prior art alloys.

The alloy of the present invention is virtually indistinguishable from 10 and higher karat white gold, is long wearing without tarnishing and is easily cast, worked, and sized with conventional techniques and materials. Importantly, the alloy of the present invention provides a relatively low cost substitute for 10 and higher karat white gold which has not heretofore been available in the art.

As set forth above, one of the major advantages of the present invention is its relatively low cost, the alloy containing preferably less than one-half karat gold. However, it is to be noted that the alloy can be made with up to 25% by weight gold. The addition of gold merely serves to increase the cost of the alloy. However, the teachings of my invention and the advantages thereof can nevertheless be used and achieved with the higher gold content. For example, an alloy having a higher gold content of 23% has been found to be suitable. This alloy has the following composition:

| | |
|---|---|
| Silver | 10% |
| Palladium | 9% |
| Nickel | 8% |
| Copper | 39% |
| Zinc | 11% |
| Gold | 23% |

This composition would have the same appearance and characteristics of the alloys described above although at a higher cost.

Thus having described the invention, what is claimed is:

1. A white gold metal alloy having good tarnish and corrosion resistance, good workability and castability and a color, luster, shine and hue characteristic of at least 10 karat white gold consisting essentially of, by weight, about 21 to 35% silver, 10–23% palladium, 3–15% nickel, 25–42% copper, 3–17% zinc, and 0–25% gold.

2. The white gold alloy of claim 1 wherein the gold content is less than about 2% by weight.

3. The white gold alloy of claim 1 further consisting essentially of, by weight, 0–5% platinum, 0 to 3% tin, 0 to 10% cadmium, 0 to 5% gallium, 0 to 3% aluminum, and 0 to 3% iron.

4. A white gold alloy having good tarnish and corrosion resistance, good workability and castability and a color, luster, shine and hue characteristic of at least 10 karat white gold consisting essentially of:

| | |
|---|---|
| Silver | 25.3 wt % |
| Palladium | 16.8 wt % |
| Nickel | 9.6 wt % |
| Copper | 32.4 wt % |
| Zinc | 13.4 wt % |
| Gold | 0.86 wt % |
| Platinum | 1.55 wt % |

5. The white gold alloy of claim 4 further consisting essentially of, by weight, 0–5% platinum, 0 to 3% tin, 0 to 10% cadmium, 0 to 5% gallium, 0 to 3% aluminum, and 0 to 3% iron.

6. An article of jewelry formed of the alloy of claim 1.

7. An article of jewelry formed of the alloy of claim 4.

* * * * *